US008680758B2

(12) United States Patent
Miller et al.

(10) Patent No.: US 8,680,758 B2
(45) Date of Patent: Mar. 25, 2014

(54) SPARK PLUG HAVING A PLASTIC UPPER INSULATOR AND METHOD OF CONSTRUCTION

(75) Inventors: Kevin L. Miller, Ida, MI (US); Richard L. Keller, Whitehouse, OH (US); William J. Walker, Jr., Toledo, OH (US); James D. Lykowski, Temperance, MI (US); Shuwei Ma, Ann Arbor, MI (US); Matthew C. Ware, Toledo, OH (US); John W. Hoffman, Perrysburg, OH (US); Mark S. McMurray, Toledo, OH (US); Brian A. Bolduc, Maumee, OH (US); David Walker, Waukesha, WI (US); Myron J. Schmenk, Lambertville, MI (US); James L. May, Summerfield, OH (US); Kevin J. Kowalski, Perrysburg, OH (US)

(73) Assignee: Federal-Mogul Ignition Company, Southfield, MI (US)

( * ) Notice: Subject to any disclaimer, the term of this patent is extended or adjusted under 35 U.S.C. 154(b) by 861 days.

(21) Appl. No.: 12/581,539

(22) Filed: Oct. 19, 2009

(65) Prior Publication Data

US 2010/0201245 A1 Aug. 12, 2010

Related U.S. Application Data

(60) Provisional application No. 61/106,698, filed on Oct. 20, 2008.

(51) Int. Cl.
*H01T 13/20* (2006.01)
*H01T 21/02* (2006.01)

(52) U.S. Cl.
USPC ..... 313/143; 313/118; 123/169 P; 445/7

(58) Field of Classification Search
USPC ..... 313/118–145, 169 R, 169 EL, 32, 41, 313/310; 445/7
See application file for complete search history.

(56) References Cited

U.S. PATENT DOCUMENTS

| | | | | |
|---|---|---|---|---|
| 1,349,367 | A | 8/1920 | Crossland | |
| 1,362,773 | A | 12/1920 | Brewster | |
| 2,356,053 | A * | 8/1944 | Hastings, Jr. et al. | 313/134 |
| 2,902,747 | A | 9/1959 | Reiter | |
| 3,077,649 | A | 2/1963 | Muniz et al. | |
| 3,350,759 | A | 11/1967 | Antunes | |
| 6,597,088 | B1 * | 7/2003 | Glaser et al. | 313/118 |
| 6,741,221 | B2 | 5/2004 | Aisenbrey | |
| 6,870,516 | B2 | 3/2005 | Aisenbrey | |
| 7,223,144 | B2 | 5/2007 | Aisenbrey | |

(Continued)

*Primary Examiner* — Nimeshkumar D. Patel
*Assistant Examiner* — Jacob R Stern
(74) *Attorney, Agent, or Firm* — Robert L. Stearns; Dickinson Wright, PLLC

(57) ABSTRACT

A spark plug and method of construction thereof is provided. The spark plug includes a metal shell having a through cavity, a lower insulator and a plastic upper insulator. The lower insulator is received in the through cavity and has a through passage with a center electrode received therein. A ground electrode is operatively attached to the shell in spaced relation from the ground electrode to provide a spark gap. The plastic upper insulator has a distal end received in the through cavity of the shell and a terminal end extending axially outwardly from the shell. The upper insulator has a through passage extending between the terminal end and the distal end. An elongate conductive member is received in the through passage of the upper insulator and is configured for electrical communication with the center electrode.

15 Claims, 2 Drawing Sheets

(56) References Cited

U.S. PATENT DOCUMENTS 7,224,108 B2 5/2007 Aisenbrey
2003/0012985 A1* 1/2003 McAlister ..... 429/12
2005/0122023 A1* 6/2005 Pool ..... 313/143
2007/0278924 A1 12/2007 Aisenbrey

* cited by examiner

SPARK PLUG HAVING A PLASTIC UPPER INSULATOR AND METHOD OF CONSTRUCTION

CROSS-REFERENCE TO RELATED APPLICATION

This application claims the benefit of U.S. Provisional Application Ser. No. 61/106,698, filed Oct. 20, 2008, which is incorporated herein by reference in its entirety.

BACKGROUND OF THE INVENTION

1. Technical Field

This invention relates generally to spark ignition devices for internal combustion engines, and more particularly to spark plugs having an upper insulator and to their method of construction.

2. Related Art

A spark plug is a spark ignition device that extends into the combustion chamber of an internal combustion engine and produces a spark to ignite a mixture of air and fuel within the combustion chamber. As illustrated in FIG. 1, a conventional spark plug 1 typically has an outer metal shell 2 with a ceramic insulator 3 at least partially received and captured in the shell 2. Further, an electrically conductive center electrode 4 typically extends partially through the insulator 3 to a firing tip 5 and a ground electrode 6 extends from the shell 2 to provide a spark gap 7 in conjunction with the firing tip 5. In addition, a metal terminal stud 9 is typically arranged in electrical communication with the center electrode 4. The terminal stud 9 commonly has an upper end exposed from the insulator 3, with the upper end having a specially profiled outer surface for attachment to an ignition wire.

Although the conventional spark plugs, such as discussed above, are generally effective in use, at least some of the components identified above and the associated manufacturing processes used to manufacture and assemble the components increase the overall cost to make the spark plugs. For example, the ceramic insulator 3 typically needs to be glazed on its outer surface to prevent contamination from attaching to its otherwise porous outer surface. Further, the ceramic insulator 3 typically needs to be attached and sealed with the metal shell 2 using one of two methods, i.e. hotlock or sillment seals, which requires specialized equipment. In addition, the common requirement for the outer surface of the upper end of the terminal stud 9 to be contoured requires secondary machining, thereby adding cost. Further, the metal terminal stud 9 needs to be cemented or fired within the ceramic insulator 3, again adding cost. Further yet, in order to decorate the outer surface of the ceramic insulator 3, as required by the customer, special heating equipment and processes need to be employed, adding yet further cost to the spark plug.

Accordingly, there is a need to reduce the costs associated with the manufacture and assembly of a spark plug. A spark plug manufactured and assembled in accordance with the invention has greatly reduced costs associated with its manufacture and assembly.

SUMMARY OF THE INVENTION

A spark plug includes an annular metal shell having a through cavity extending axially along a central axis, an annular lower insulator and a separate annular plastic upper insulator. The lower insulator is received at least in part in the through cavity of the metal shell. The lower insulator has a through passage extending between an upper end and a lower end. A ground electrode is operatively attached to the shell, with the ground electrode having a ground electrode sparking surface. A center electrode is received at least in part in the through passage of the lower insulator. The center electrode has a center electrode sparking surface extending from the lower end of the lower insulator to provide a spark gap between the center electrode sparking surface and the ground electrode sparking surface. The annular, plastic upper insulator has a distal end received in the through cavity of the metal shell and a terminal end extending axially outwardly from the metal shell. The upper insulator has a through passage extending between the terminal end and the distal end. An elongate conductive member is received at least in part in the through passage of the upper insulator and is configured for electrical communication with the center electrode.

In accordance with another aspect of the invention, a method of constructing a spark plug is provided. The method includes providing a metal shell having a through cavity; disposing a ceramic lower insulator having a through passage in the through cavity, and disposing a center electrode in the through passage of the lower insulator. Then molding a plastic upper insulator at least in part within the through cavity and providing an electrical member in the upper insulator for electrical communication with the center electrode.

In accordance with another aspect of the invention, the plastic upper insulator has a molded terminal formed as one piece of plastic material with the upper insulator, with the terminal having an outer, "as molded" undulating surface configured for attachment to an ignition wire.

In accordance with another aspect of the invention, the metal shell has a retention feature to facilitate fixing the plastic upper insulator to the shell.

In accordance with another aspect of the invention, the retention feature is one of a groove or a protrusion.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
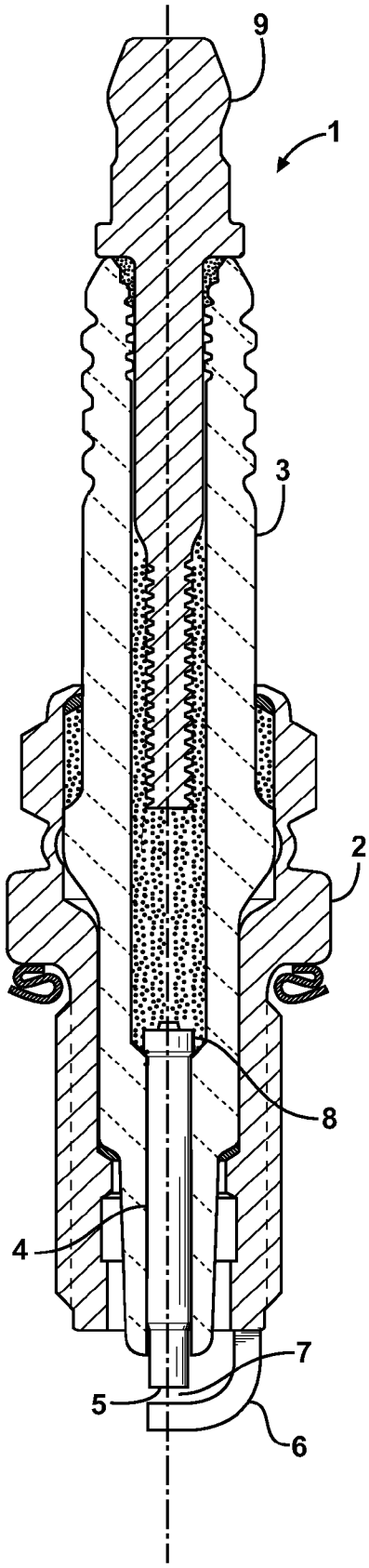
FIG. 1 Prior Art
FIG. 1 is a cross-sectional view of a spark plug constructed in accordance with prior art.
Figure 2:
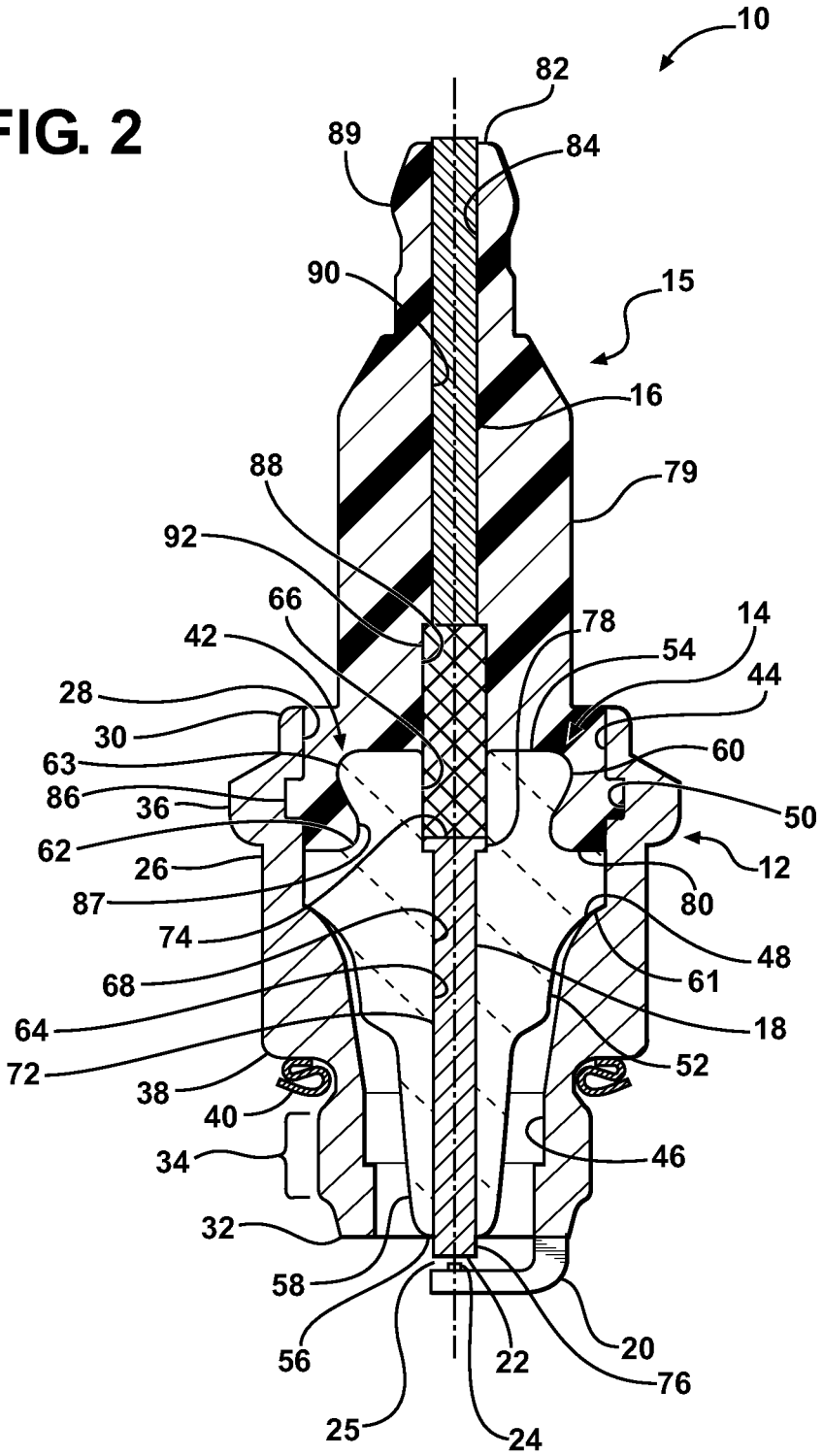
FIG. 2 is a cross-sectional view of a spark plug constructed in accordance with one presently preferred embodiment of the invention.

Referring in more detail to the drawings, FIG. 2 illustrates a spark ignition device constructed in accordance with one presently preferred aspect of the invention, referred to hereafter as spark plug 10, used for igniting a fuel/air mixture within an internal combustion engine (not shown). The spark plug 10 includes an annular metal casing, also referred to as a housing or shell 12; a non-conductive, dielectric ceramic lower insulator 14 received and secured at least in part within the shell 12; a non-conductive, plastic upper insulator 15 received and secured at least in part within the shell 12; a conductive member 16 and a center electrode 18 secured within the respective upper and lower insulators 15, 14 and in electrical communication with one another, and a ground electrode 20 operably attached to and extending from the shell 12. The center and ground electrodes 18, 20 have respective firing tips or sparking surfaces 22, 24 located opposite each other to provide a spark gap 25. With the upper insulator 15 being constructed from a plastic material, the costs associated with the manufacturing processes of the spark plug 10, as described herein and shown in the drawings, are greatly reduced.

The electrically conductive metal shell 12 may be made from any suitable metal, including various coated and uncoated steel alloys. The shell 12 has a generally tubular body 26 with an annular inner surface 28 extending between an upper terminal end 30 and a lower fastening end 32. The fastening end 32 typically has an external threaded region 34 configured for threaded attachment within a combustion chamber opening of an engine block (not shown). The shell 12 may be provided with an external hexagonal tool receiving member 36 or other feature for removal and installation of the spark plug 10 in the combustion chamber opening. The feature size will preferably conform with an industry standard tool size of this type for the related application. Of course, some applications may call for a tool receiving interface other than a hexagon, such as slots to receive a spanner wrench, or other features such as are known in racing spark plug and other applications. The shell 12 also has an annular, generally planar sealing seat 38 from which the threaded region 34 depends. The sealing seat 38 may be paired with a gasket 40 to facilitate a hot gas seal of the space between the outer surface of the shell 12 and the threaded bore in the combustion chamber opening.

The ground electrode 20 is attached to the fastening end 32, as is known, and is depicted in a commonly used single L-shaped style, it will be appreciated that multiple ground electrodes of straight, bent, annular, trochoidal and other configurations can be substituted depending upon the intended application for the spark plug 10, including two, three and four ground electrode configurations, and those where the electrodes are joined together by annular rings and other structures used to achieve particular sparking surface configurations. The ground electrode 20 sparking surface 24 may have any suitable cross-sectional shape, including flat, arcuate, tapered, pointed, faceted, round, rectangular, square and other shapes, and the shapes of these sparking surfaces may be different.

The inner surface 28 of the shell 12 provides an open through cavity 42 extending through the length of the shell between the terminal and fastening ends 30, 32. The inner surface 28 has an enlarged diameter region 44 adjacent the terminal end 30 and a reduced diameter region 46 adjacent the fastening end 32, with an annular shoulder 48 extending radially inwardly from the enlarged diameter region 44 to the reduced diameter region 46. The shoulder 48 is shown as having a tapered, convex surface, however, shoulders of different configurations are contemplated herein, such as having sharp corners, for example. The enlarged diameter region 44 extends upwardly from the shoulder 48 and has a generally straight, cylindrical diameter, with the exception of a retention feature, which can be provided as a radially inwardly extending protrusion or, as represented here, by way of example and with limitation, as a radially outwardly extending notch or annular groove 50 located generally between the shoulder 48 and the terminal end 30.

The lower insulator 14, which may include aluminum oxide or another suitable electrically insulating material having a specified dielectric strength, high mechanical strength, high thermal conductivity, and excellent resistance to thermal shock, may be press molded from a ceramic powder in a green state and then sintered at a high temperature sufficient to densify and sinter the ceramic powder. The lower insulator 14 has an elongate tubular body with an annular outer surface 52 extending between an upper terminal or proximal end 54 and a lower firing or distal end 56. The lower insulator 14 has a nose portion 58 having a slight taper converging toward the distal end 56, although other configurations, including a straight cylindrical shape are contemplated herein. A bulbous portion 60 extends from the proximal end 54 to an enlarged diameter shoulder 61. The bulbous portion 60 is shown as having a retention feature, represented here as a reduced diameter providing a radially inwardly extending annular pocket, also referred to as necked down region 62, immediately adjacent the shoulder 61 and an enlarged diameter region 63 immediately adjacent the proximal end 54. The lower insulator 14 has a length such that when the shoulder 61 of the insulator 14 abuts the shoulder 48 of the shell 12, the bulbous portion 60 is located in generally aligned relation radially inward from the annular groove 50, while the distal end 56 is generally flush with the fastening end 32 of the shell 12.

The lower insulator 14 further includes a central through passage 64 extending longitudinally between the upper proximal end 54 and the lower distal end 56. The central through passage 64 is represented here as having a varying cross-sectional area, with an increased diameter section 66 extending from the proximal end 54 generally through the bulbous portion 60, and a reduced diameter section 68 extending from the increased diameter section 66 to the distal end 56. An annular shoulder 70 extends generally radially between the respective sections 66, 68.

The center electrode 18 may have any suitable shape, and is represented here, by way of example and without limitation, as having a body with a generally cylindrical outer surface 72 extending generally between an upper terminal end 74 and a lower firing end 76, and having an increased diameter head 78 at the terminal end 74. The annular head 78 facilitates seating and sealing the terminal end 74 within through passage 64 of the lower insulator 14 against the shoulder 70. The firing end 76 of the center electrode 18 generally extends out of nose portion 58 of the lower insulator 14. The center electrode 18 is constructed from any suitable conductor material, as is well-known in the field of sparkplug manufacture, such as various Ni and Ni-based alloys, for example, and may also include such materials clad over a Cu or Cu-based alloy core.

The plastic upper insulator 15 is fixedly attached to the metal shell 12 and preferably to the upper proximal end 54 of the ceramic lower insulator 14. The upper insulator 15 has an outer surface 79 extending between opposite distal and terminal ends 80, 82 with a central through passage 84 extending between the ends 80, 82 and configured for axial alignment with the central through passage 64 of the lower insulator 14. The outer surface 79 has a retention feature to facilitate fixing the upper insulator 15 to the shell 12, wherein the retention feature is represented here, by way of example and without limitation, as a radially outwardly extending annular rib 86 received and fixed, "as molded", in the groove 50 and a radially inwardly extending shoulder 87 received and fixed, "as molded", in the necked down region or annular pocket 62 of the lower insulator 14. Accordingly, the annular rib 86 and the annular groove 50 confront one another and the annular shoulder 87 and the annular pocket 62 confront one another to prevent relative axial movement between the upper insulator 15, the lower insulator 14, and the shell 12. It should be recognized that the retention feature could be provided inversely (not shown), with the shell 12 having a radially outward extending annular rib or projection and the upper insulator 15 being molded about the projection to interlock the upper insulator 15 to the shell 12.

The outer surface 79 immediately adjacent the terminal end 82 has an undulating profile 89 configured for attachment to an ignition wire (not shown). Accordingly, a separate terminal connector is not needed. The through passage 84 is represented as having an enlarged diameter region 88 extending from the distal end 80 axially to a radially inwardly extending shoulder 91 that transitions the through passage 84 to a slightly reduced diameter region 90, in comparison with the enlarged diameter region 88, that extends to the terminal end 82. The reduced diameter region 90 receives, or is formed about, the conductive member 16 therein, which is configured for electrical communication with the center electrode 18. The enlarged diameter region 88 receives, or is formed about, a suppressor or resistor layer 92, as is known, made from any suitable composition known to reduce electromagnetic interference ("EMI"), by way of example and without limitation, wherein the resistor layer 92 extends between the conductive member 16 and the terminal end 74 of the center electrode 18.

With the upper insulator 15 being molded of plastic, the outer surface need not be glazed, and further, the outside surface can be provided with any desired labeling or decorations. For example, the decorations could be molded directly into the outer surface via impressions from a mold cavity, or the decorations could be provided via insert decorating, laser marking or screen printing, for example.

In accordance with a presently preferred method of constructing the spark plug 10, the lower insulator 14 is disposed in the shell 12 by inserting the distal end 56 into the cavity 42 until the shoulder 61 of the lower insulator 14 engages the positive stop shoulder 48 of the shell 12 to form a subassembly. Thereafter, the center electrode 18 is disposed within the through passage 64 of the lower insulator 14 wherein the enlarged head 78 seats against the shoulder 70. Then, the resistor layer 92 is disposed in the enlarged section 66 of the through passage 64 of the lower insulator 14. It is also contemplated that the conductive member 16 could be disposed in the mold cavity in attachment with the resistor layer 92 prior to form the upper insulator 15. Then, the subassembly is placed in a mold cavity, whereupon the plastic is injected into the mold cavity to form the single, monolithic piece of material forming the molded upper insulator 15. As such, during the molding process the through passage 84 in the upper insulator 15 can be formed "as molded" about the resistor layer 92 and the conductive member 16, thereby doing away with any secondary operations to form the through passage 84. In addition, as mentioned, provisions can also be made for forming the outer surface undulating profile 89, "as molded", as desired, and for decorating the outer surface 79, "as molded", as desired, thereby further doing away with secondary operations. As such, upon being constructed, the respective through passages 64, 84 of the lower insulator 14 and the upper insulator 15 are axially aligned with one another to provide an enlarged diameter central portion 88 between said terminal end 82 of the upper insulator 15 and the lower end 56 of the lower insulator 14 and reduced diameter portions 90, 68 spaced axially from one another by the central portion 88.

During the molding process, the plastic flows within the cavity 42 of the shell 12 and about the bulbous portion 60 of the lower insulator 14 to fix and seal the upper insulator 15 relative to the shell 12 and the lower insulator 14. The plastic flows throughout or substantially throughout the radially outwardly extending annular groove 50 of the shell 12 and throughout or substantially throughout the radially inwardly extending annular pocket 62 of the lower insulator 14 and then solidifies therein to form the interlocking annular rib 86 and the interlocking annular shoulder 87. As such, the annular rib 86 is enclosed or encased in interlocking relation within the annular groove 50 and the annular shoulder 87 is enclosed or encased in interlocking relation within the annular pocket 62, thereby fixing the upper insulator 15 to the lower insulator 14 and preventing relative axial movement between the lower insulator 14 and the upper insulator 15 against detachment from one another.

Obviously, many modifications and variations of the present invention are possible in light of the above teachings. It is, therefore, to be understood that within the scope of the appended claims, the invention may be practiced otherwise than as specifically described.

What is claimed is:

1. A spark plug, comprising:

an annular metal shell having a through cavity extending axially along a central axis;

an annular, lower insulator received at least in part in said through cavity of said metal shell, said lower insulator having a through passage extending between an upper end and a lower end;

a ground electrode operatively attached to said shell, said ground electrode having a ground electrode sparking surface;

a center electrode received at least in part in said through passage of said lower insulator, said center electrode having a center electrode sparking surface extending from said lower end of said lower insulator to provide a spark gap between said center electrode sparking surface and said ground electrode sparking surface;

an elongate conductive member;

an annular, plastic upper insulator having a distal end received in said through cavity of said metal shell and a terminal end extending axially outwardly from said metal shell, said upper insulator having a through passage extending between said terminal end and said distal end, said elongate conductive member being received at least in part in said through passage of said upper insulator and being configured for electrical communication with said center electrode; and wherein said lower insulator has a radially inwardly extending annular pocket and said upper insulator has an annular shoulder extending into said annular pocket, said shoulder and said pocket confronting one another and preventing relative axial movement between said lower insulator and said upper insulator.

2. The spark plug of claim 1 wherein said metal shell has a retention feature within said through cavity, said upper insulator being molded to said retention feature.

3. The spark plug of claim 2 wherein said retention feature is an annular groove extending radially outwardly from said through cavity, said upper insulator having an annular rib extending into said annular groove, said groove and said rib confronting one another and preventing relative axial movement between said upper insulator and said shell.

4. The spark plug of claim 3 wherein said annular rib is fixed against removal from said annular groove.

5. The spark plug of claim 3 wherein said lower insulator includes a bulbous portion adjacent said upper end, said bulbous portion includes said radially inwardly extending annular pocket, and said bulbous portion is located in generally aligned relation radially inward from said annular groove of said metal shell.

6. The spark plug of claim 1 wherein said lower insulator is ceramic.

7. The spark plug of claim 1 wherein said annular shoulder is molded to said annular pocket and fixed against removal from said annular pocket.

8. The spark plug of claim 1 wherein said lower insulator and said upper insulator have central through passages axially aligned with one another to provide an enlarged diameter central portion between said terminal end of said upper insulator and said lower end of said lower insulator and reduced diameter portions spaced axially from one another by said central portion.

9. The spark plug of claim 1 wherein said lower insulator includes an outer surface having an undulating profile for attachment to an ignition wire.

10. The spark plug of claim 1 wherein said shell has an annular rib extending radially outwardly from said through cavity and said upper insulator is molded about said annular rib.

11. A method of constructing a spark plug, comprising:

providing a metal shell having a through cavity;

disposing a ceramic lower insulator having a through passage in the through cavity of the metal shell;

disposing a center electrode in the through passage of the ceramic lower insulator; and molding a plastic upper insulator at least in part within the through cavity of the metal shell, the plastic upper insulator having a through passage, and providing an electrical member in the through passage of the plastic upper insulator for electrical communication with the center electrode, and wherein the ceramic lower insulator has a radially inwardly extending annular pocket and the plastic upper insulator has an annular shoulder extending into the annular pocket, the shoulder and the pocket confronting one another and preventing relative axial movement between the ceramic lower insulator and the plastic upper insulator.

12. The method of claim 11 further including forming a retention feature in the through cavity of the shell and molding the upper insulator to the retention feature.

13. The method of claim 11 further including forming the retention feature as an annular groove in the shell and molding the plastic insulator to substantially fill the annular groove.

14. The method of claim 11 further including molding the upper insulator at least partially about the electrical member.

15. The method of claim 14 further including disposing a resistor layer between the center electrode and the electrical member and molding the upper insulator at least partially about the resistor layer.

* * * * *